US009249938B2

(12) United States Patent
Hu et al.

(10) Patent No.: US 9,249,938 B2
(45) Date of Patent: Feb. 2, 2016

(54) LIGHT EMITTING DIODE LIGHT SOURCE MODULE HAVING UNIFORM ILLUMINATION

(71) Applicant: HON HAI PRECISION INDUSTRY CO., LTD., New Taipei (TW)

(72) Inventors: Chau-Jin Hu, New Taipei (TW); Yung-Lun Huang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 252 days.

(21) Appl. No.: 14/072,693

(22) Filed: Nov. 5, 2013

(65) Prior Publication Data

US 2015/0043217 A1 Feb. 12, 2015

(30) Foreign Application Priority Data

Aug. 7, 2013 (TW) ..... 102128200

(51) Int. Cl.

| | |
|---|---|
| ***F21V 5/00*** | (2015.01) |
| ***F21K 99/00*** | (2010.01) |
| ***F21V 5/04*** | (2006.01) |
| *F21Y 101/02* | (2006.01) |

(52) U.S. Cl.

CPC ... *F21K 9/50* (2013.01); *F21V 5/04* (2013.01); *F21Y 2101/02* (2013.01)

(58) Field of Classification Search

CPC ..... F21K 9/50; F21V 13/04; F21V 5/04; G02B 3/0037; G02B 3/005; G02B 3/0006; F21Y 2101/02

See application file for complete search history.

(56) References Cited

U.S. PATENT DOCUMENTS

| | | | | |
|---|---|---|---|---|
| 2005/0265029 | A1* | 12/2005 | Epstein | G02B 3/0056 362/339 |
| 2008/0100773 | A1* | 5/2008 | Hwang | G02B 3/005 349/62 |
| 2008/0303977 | A1* | 12/2008 | Sekiguchi | G02F 1/133606 349/64 |
| 2011/0292302 | A1* | 12/2011 | Park | G02B 19/0071 348/739 |
| 2013/0050588 | A1* | 2/2013 | Kamada | G02F 1/133603 348/739 |
| 2014/0098544 | A1* | 4/2014 | Shin | H05K 3/0052 362/308 |
| 2014/0160733 | A1* | 6/2014 | Ono | F21K 9/50 362/97.1 |
| 2014/0218625 | A1* | 8/2014 | Kuromizu | H04N 5/66 348/790 |
| 2014/0327832 | A1* | 11/2014 | Fukai | G02F 1/133603 348/725 |
| 2015/0042935 | A1* | 2/2015 | Yamamoto | G02B 5/0231 349/112 |
| 2015/0098226 | A1* | 4/2015 | Chen | F21V 13/04 362/299 |
| 2015/0192255 | A1* | 7/2015 | Kim | H01L 33/58 362/293 |

* cited by examiner

*Primary Examiner* — Stephen F Husar
*Assistant Examiner* — Gerald J Sufleta, II
(74) *Attorney, Agent, or Firm* — Novak Druce Connolly Bove + Quigg LLP

(57) ABSTRACT

An LED (light emitting diode) light source module includes a first optical lens, an LED light source received in a groove of the first optical lens and a second optical lens located at a light path of the LED light source and above the first optical lens. The first optical lens includes a first reflecting surface around the groove and a second reflecting surface. The second optical lens includes a reflecting surface facing the LED light source, and light which is incident to the reflecting surface of the second optical lens is reflected thereby to the first reflecting surface and the second reflecting surface of the first optical lens. A light diffusion plate is attached to the second optical lens at a position away from the reflecting surface of the second optical lens.

14 Claims, 2 Drawing Sheets

LIGHT EMITTING DIODE LIGHT SOURCE MODULE HAVING UNIFORM ILLUMINATION

BACKGROUND

1. Technical Field

The present disclosure relates to light source modules, and more particularly to an LED (light emitting diode) light source module having a uniform distribution of light output, whereby the LED light source module is suitable for illuminating a planar display, for example, a liquid crystal display (LCD) or a sign box.

2. Description of Related Art

LEDs have been widely promoted as light sources of electronic devices owing to many advantages, such as high luminosity, low operational voltage and low power consumption. However, a traditional LED light source module commonly includes a plurality of LED light sources, a plurality of optical lenses and a diffusion plate positioned above the optical lenses. Each of the optical lenses covers the corresponding LED light source. However, to obtain a large and uniform light illumination area, a distance between the LED light sources and the diffusion plate needs to be not too small, thereby causing the LED light source module to be bulky, which is unfavorable in view of the requirement of compact design of electronic apparatus.

Therefore, an LED light source module which is capable of overcoming the above described shortcomings is desired.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
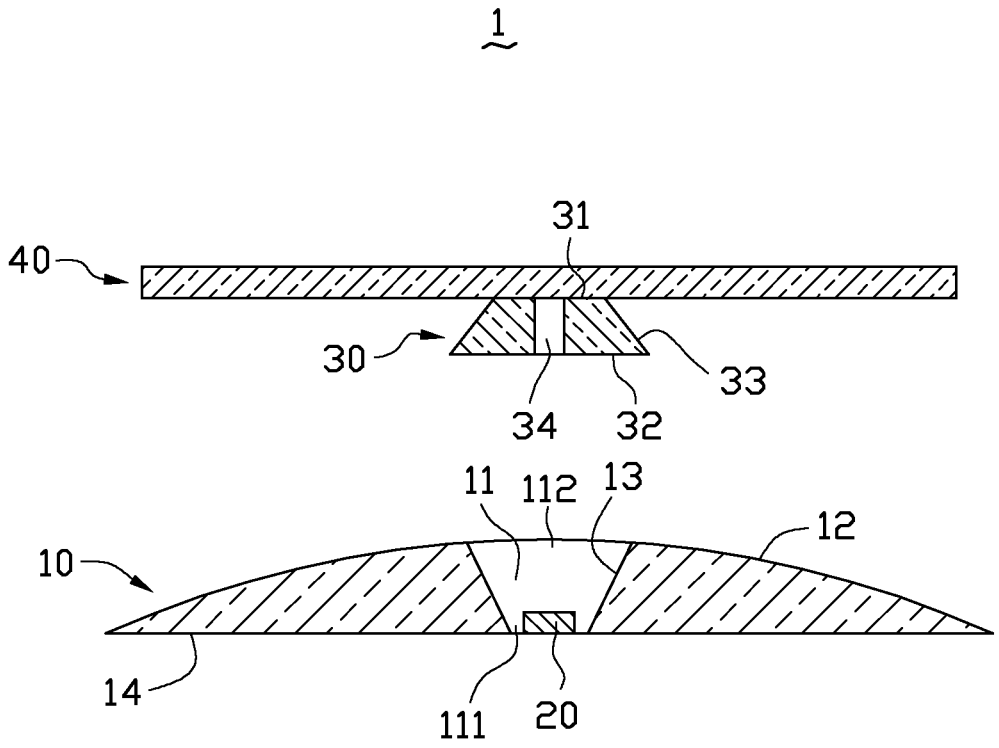
FIG. 1 shows a cross sectional view of an LED light source module in accordance with a first embodiment of the present disclosure.

Referring to FIG. 1, an LED light source module 1 in accordance with a first embodiment of the present disclosure includes a first optical lens 10, an LED light source 20 located in the first optical lens 10, a second optical lens 30 located on a light path of the LED light source 20 and a diffusion plate 40 attached to the second optical lens 30, wherein the second optical lens 30 is located between the first optical lens 10 and the diffusion plate 40. The LED light source module 1 is a planar light source which is used to illuminate a planar display device such a liquid crystal display (LCD) or a sign box.

The first optical lens 10 is generally spherical dome-shaped, and defines a groove 11 in the middle thereof. The first optical lens 10 includes a first reflecting surface 13, a second reflecting surface 12 and a connecting surface 14 interconnecting the second reflecting surface 12 and the first reflecting surface 13. In this embodiment, the first reflecting surface 13 is an inner lateral surface around the groove 11, the second reflecting surface 12 is an outer spherical surface facing the second optical lens 30, and the connecting surface 14 is a flat bottom surface remote from the second optical lens 30. The groove 11 has a profile like an inverted frustum of a cone, the second reflecting surface 12 is arced, and the connecting surface 14 is an annular, flat surface around the groove 11. The first reflecting surface 13 and the second reflecting surface 12 both have a good light reflecting characteristic. The groove 11 has a receiving end 111 and a light output end 112 opposite to the receiving end 111, and the LED light source 20 is received in the receiving end 111. A diameter of the light output end 112 is larger than that of the receiving end 111.

The LED light source 20 is received in the receiving end 111 of the groove 11, and the size of the LED light source 20 is slightly smaller than or equal to that of the receiving end 111 of the groove 11. In this embodiment, the LED light source 20 is an LED package, and the light output surface of the LED light source 20 faces to the light output end 112 of the groove 11.

The second optical lens 30 is located above the LED light source 20, and has a profile like a frustum of a cone. The second optical lens 30 is spaced from the first optical lens 10. The second optical lens 30 includes a contacting surface 31, a reflecting surface 32 opposite to the contacting surface 31, and a lateral surface interconnecting the contacting surface 31 and the reflecting surface 32. The contacting surface 31 contacts the diffusion plate 40. The reflecting surface 32 faces the second reflecting surface 12 of the first optical lens 10 and aligns with the LED light source 20. The second optical lens 30 defines a light through hole 34, and the light through hole 34 extends through a middle of the second optical lens 30 from the contacting surface 31 to the reflecting surface 32. The light through hole 34 is aligned with the groove 11 of the first optical lens 10, and the size of the light through hole 34 is much less than that of the light output end 112 of the groove 11. In this embodiment, the contacting surface 31 and the reflecting surface 32 are both annular, and an area of the reflecting surface 32 is greater than an area defined by the light output end 112 of the groove 11. Alternatively, the area of the reflecting surface 32 can be equal to that of the light output end 112 of the groove 11. The reflecting surface 32 has a good light reflection characteristic, and light which is incident to the reflecting surface 32 of the second optical lens 30 is reflected thereby to the first reflecting surface 13 and the second reflecting surface 12 of the first optical lens 10.

The diffusion plate 40 is a thin plate, and the contacting surface 31 of the second optical lens 30 is attached to the light input surface of the diffusion plate 40.

During operation of the LED light source 20, one part of the light emitted from the LED light source 20 travels toward the first reflecting surface 13 of the first optical lens 10, and is reflected thereby toward the second optical lens 30. The other part of the light travels toward the second optical lens 30 directly. A small part of the light travelling toward the second optical lens 30 runs through the light through hole 34 of the second optical lens 30 into the diffusion plate 40. The other large part of the light travels toward the reflecting surface 32 of the second optical lens 30, and is further reflected thereby to the second reflecting surface 12 and the first reflecting surface 13. Thus, the other large part of the light is repeatedly reflected between the first optical lens 10 and the second optical lens 20 until it finally travels into the diffusion plate 40. Finally, the light beams entering the diffusion plate 40 leave the light diffusion plate 40 from a top light output surface thereof after the light beams are sufficiently diffused and mixed in the diffusion plate 40. Therefore, the light output of the LED light source module 1 is more uniform, thereby decreasing the irregularities of the light output of the LED light source module 1. Additionally, for the large part of the light being repeatedly reflected between the first optical lens 10 and the second optical lens 20, and finally travelling toward the diffusion plate 40 and outputting, the distance between the LED 20 and the diffusion plate 40 can be reduced, whereby a thickness of the LED light source module 1 can be reduced accordingly. In this embodiment, the thickness of the LED light source module 1 is less than 2 mm, whereby an electronic apparatus incorporating the LED light source module 1 is compact.

Figure 2:
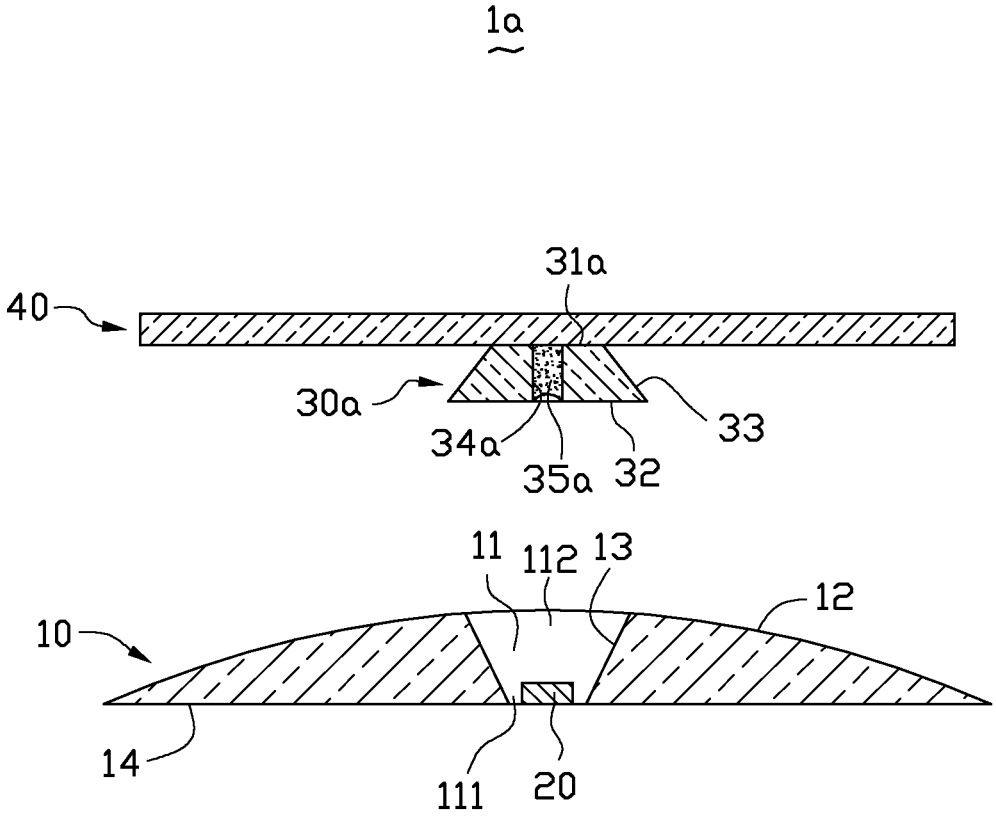
FIG. 2 shows a cross sectional view of an LED light source module in accordance with a second embodiment of the present disclosure.

Referring to FIG. 2, it is a cross sectional view of an LED light source module la in accordance with a second embodiment of the present disclosure. The LED light source module 1*a* is similar to the LED light source module 1 of the first embodiment, wherein only the structure of the second optical lens 30*a* is different from the second optical lens 30. The difference is: the light through hole 34*a* of the second optical lens 30*a* is filled with transparent filling 35*a*, such as transparent resin or transparent silicone. A top end of the transparent filling 35*a* is coplanar with the contacting surface 31*a* of the second optical lens 30*a*, and a bottom end of the transparent filling 35*a* is curved and upwardly depressed toward the contacting surface 31*a*, whereby the light emitted from the LED light source 20 is more divergently distributed into the diffusion plate 40 since the upward recessed bottom end of the transparent filling 35*a* can refract the light from the LED light source 20 sideward.

When the LED light source module 1 (1*a*) is used as a backlight module, the backlight module is thinner, and the light output of the backlight module is more uniform. Therefore, the display panel of a television or a monitor which uses the LED light source module 1 (1*a*) is thinner.

When the LED light source module 1 (1*a*) is used as a lamp, the lamp is thinner, and the light output of the lamp is more uniform.

Particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. An LED (light emitting diode) light source module, comprising:

a first optical lens;

an LED light source received in the first optical lens;

a second optical lens located at a light path of the LED light source, aligned with the LED light source and above the first optical lens;

wherein the first optical lens defines a groove, the LED light source is received in the first optical lens, the first optical lens comprises a first reflecting surface around the groove, a second reflecting surface facing the second optical lens and a connecting surface interconnecting the second reflecting surface and the first reflecting surface, the second optical lens comprises a reflecting surface facing the LED light source, light which is incident to the reflecting surface of the second optical lens from the LED light source and the first optical lens is reflected thereby to the first reflecting surface and the second reflecting surface of the first optical lens; wherein the second optical lens further comprises a contacting surface opposite to the reflecting surface thereof, the second optical lens defines a light through hole, the light through hole is aligned with the groove of the first optical lens, and the light through hole extends through a middle of the first optical lens from the contacting surface to the reflecting surface of the second optical lens.

2. The LED light source module of claim 1, wherein a size of the light through hole is less than that of the groove.

3. The LED light source module of claim 2, wherein an area of the reflecting surface of the second optical lens is greater than an area defined by an opening end of the groove of the first optical lens near the second optical lens.

4. The LED light source module of claim 1, wherein the first optical lens is a spherical dome, and the groove extends through the first optical lens.

5. The LED light source module of claim 4, wherein the groove has a profile like an inverted frustum of a cone.

6. The LED light source module of claim 1 further comprising a diffusion plate attached to the second optical lens at a position thereof away from the reflecting surface of the second optical lens.

7. An LED (light emitting diode) light source module, comprising:

a first optical lens;

an LED light source received in the first optical lens;

a second optical lens located at a light path of the LED light source and aligned with the LED light source;

wherein the first optical lens defines a groove, the LED light source is received in the groove of the first optical lens, the first optical lens comprises a first reflecting surface, a second reflecting surface and a connecting surface interconnecting the second reflecting surface and the first reflecting surface, the second optical lens comprises a reflecting surface facing the LED light source and a contacting surface opposite to the reflecting surface, light which is incident to the reflecting surface of the second optical lens is reflected to the first reflecting surface and the second reflecting surface of the first optical lens, the second optical lens defines a light through hole, the light through hole is aligned with the groove of the first optical lens and filled with transparent filling, and the light through hole extends through a middle of the second optical lens from the contacting surface to the reflecting surface of the second optical lens;

wherein a top end of the filling is coplanar with the contacting surface of the second optical lens, and a bottom end of filling is curved and depressed toward the contacting surface.

8. The LED light source module of claim 7, wherein a size of the light through hole is less than that of the groove.

9. The LED light source module of claim 7, wherein an area of the reflecting surface of the second optical lens is greater than that of an opening end of the groove of the first optical lens near the second optical lens.

10. The LED light source module of claim 7, wherein the first optical lens is a spherical dome, and the groove extends through the first optical lens.

11. The LED light source module of claim 10, wherein the groove has a profile like an inverted frustum of a cone.

12. The LED light source module of claim 7 further comprising a diffusion plate, wherein the diffusion plate is attached to the contacting surface of the second optical lens.

13. An LED light source module comprising:

a spherical dome-shaped first optical lens defining a groove in a center thereof, an inner surface of the first optical lens defining the groove being light reflective, an spherical surface of the first optical lens being also light reflective;

an LED received in the groove;

a second optical lens located over the groove, having a bottom face which is light reflective and faces the inner surface and the spherical surface of the first optical lens; and a light diffusion plat located over the second optical lens and attached to a top surface of the second optical lens;

wherein a through hole is defined in a middle of the second optical lens, and the through hole is filled with a transparent filling therein, the transparent filling is one of transparent resin and silicone; and wherein a bottom of the transparent filling is curved and recessed toward the light diffusion plate.

14. The LED light source module of claim 1, wherein the groove has a shape of an inverted frustum of a cone, and the second optical lens has a shape of a frustum of a cone.

* * * * *